106-84 AU 113 EX
9/13/83 XR 4,404,030

United States Patent [19]
Komura et al.

[11] 4,404,030
[45] Sep. 13, 1983

[54] ANTI-PLATING AGENT FOR ONE-SIDE HOT-DIP PLATING PROCESS

[75] Inventors: Hideo Komura, Ichihara; Kazuaki Kyohno, Chiba; Takahisa Yoshihara, Chiba; Syoji Shijima, Chiba; Minari Goto, Kurashiki, all of Japan

[73] Assignee: Kawasaki Steel Corporation, Kobe, Japan

[21] Appl. No.: 361,082

[22] Filed: Mar. 23, 1982

[30] Foreign Application Priority Data

Mar. 27, 1981 [JP] Japan ..... 56-45295
Oct. 26, 1981 [JP] Japan ..... 56-171264

[51] Int. Cl.[3] ..... B05D 5/08
[52] U.S. Cl. ..... 106/2; 106/84; 427/156; 427/300
[58] Field of Search ..... 427/156, 300; 106/2, 106/84

[56] References Cited

U.S. PATENT DOCUMENTS 3,121,019 2/1964 Blay ..... 427/300
3,398,010 8/1968 Harvey et al. ..... 427/300
3,416,939 12/1968 Schutt et al. ..... 106/84

*Primary Examiner*—Lorenzo B. Hayes
*Attorney, Agent, or Firm*—Young & Thompson

[57] ABSTRACT

Disclosed is an anti-plating agent for use in hot-dip plating process, having the following two kinds of composition. The composition of the first kind includes an alkali silicate; boric acid, and alkali hydroxide, magnesia and/or magnesium hydroxide, titania and/or titanium hydroxide, and at least one compound selected from a group consisting of alumina, aluminium hydroxide and alumina zol. The composition of the second kind includes an alkali silicate, boric acid, alkali hydroxide, magnesia and/or magnesium hydroxide, alumina and/or aluminium hydroxide, and at least one kind of titanium oxide and titanium complex oxide and/or at least one kind of zirconium oxide and zirconium complex oxide. These anti-plating agents have a good anti-plating effect and permit an easy separation of the coating film and, hence, can suitably be used in one-side hot-dip plating of steel sheets.

7 Claims, No Drawings

ANTI-PLATING AGENT FOR ONE-SIDE HOT-DIP PLATING PROCESS

BACKGROUND OF THE INVENTION

1. Field of the Invention

The present invention relates to an anti-plating agent for use in the production of one-side plated steel sheet or strip by hot-dip process.

2. Description of the Prior Art

Recently, in the field of the steel sheet to be used for automobiles, domestic electric equipments, building materials and the like, it has been eagerly demanded to produce a so-called one-side plates steel sheet by plating only one side of a steel sheet to give the sheet a sufficiently high corrosion resistance and, at the same time, to improve the weldability of the sheet.

One-side plated sheet can be produced by the electroplating process, but the electroplating process is low in the plating speed and high in the production cost of the sheet. Therefore, the hot dip process is advantageously used in the production of the one-side plates steel sheet on a large scale.

There have hitherto been proposed various methods in the production of one-side plates steel sheet by the hot-dipping process. For example, the following methods are known in the production of zinc-plated steel sheet, that is, a method wherein two steel sheets are superposed and welded at the edge, and the welded steel sheets are plated, and then the welded edge is cut off; a method wherein molten zinc is plated on only one side of a steel sheet by the roll coating method, curtain-flow coating method or other particular method; a method wherein plating is effected on both sides of the steel sheet and then the plating layer on one side is removed by an electrolysis or grinding; a method wherein an anti-plating agent is applied beforehand on one side of the steel sheet and is removed after the plating; and a method wherein the plating is effected on only one side of the steel sheet by elevating or protruding the surface of the bath by means of ultrasonic wave or an electromagnetic pump.

These known methods, however, are generally impractical to carry out and raise the cost of production uneconomically. For these reasons, only few of them are put into production in the commercial scale.

As the conventional one-side zinc plating methods employing anti-plating agent, the following technics have been known. Namely, Japanese patent application publication No. 7,112/64 discloses the use of waterglass, while Japanese patent application publication No. 4,204/64 teaches the use of an aqueous slurry of a mixture of CaO, MgO and alkali metaborate. Japanese patent laid-open No. 48.029/78 teaches the use of an aqueous slurry consisting mainly of alkali metal silicate and ammonium silicate, while Japanese patent application publication No. 8,101/76 discloses a plating prohibitor consisting essentially of a silicon resin. The use of an aqueous slurry of scale-like synthetic silicon compound is disclosed in Japanese patent laid-open No. 64,026/79. Also, U.S. Pat. No. 3,121,019 discloses the use of alkali earth metal oxides.

These methods, however, still have the following drawbacks. That is, in the continuous hot-dip metal plating process, wherein a steel sheet with an anti-plating film coated thereon is annealed in reducing atmosphere (usually at 700° C.) just before the plating by the hot-dipping, the anti-plating film coating the sheet surface decomposes or partly exfoliates from the steel sheet surface during the annealing. It is, therefore, difficult to completely prevent one side of the sheet from being plated. Moreover, the steel is sometimes oxidized in the air after plating, and a troublesome step is required in order to reduce or mechanically remove the oxide. Further, the film formed on one side of the steel sheet by the coating agent is generally poor in the peeling property, and it is almost impossible to remove the film completely without deteriorating the appearance of the steel sheet surface. In addition, the removal of the film is usually expensive.

As the anti-plating agents which can effectively prevent the plating and attaching of molten metal onto the coating layer while exhibiting good peeling property, the present inventors have already proposed an aqueous slurry containing four constituents: namely, magnesia, boric acid, an alkali and alkali silicate, in Japanese patent laid-open No. 146,730/77. Subsequently, the inventors proposed in Japanese Patent Laid-open No. 119,157/80 and aqueous slurry of 5-component system containing, in addition to the four constituents mentioned above, titania or titanium hydroxide.

These anti-plating agents, however, still suffered the following drawbacks. Namely, in the continuous hot-dip zinc plating method having the step of annealing in a reducing atmosphere in advance to the plating, the zinc attaches to the coating layer of the anti-plating agent when the speed of pulling out of the steel from the molten zinc bath is too high or when the annealing is conducted at a temperature above the $A_1$ transformation temperature aiming at achieving a higher workability of the zinc-plated steel sheet. The attaching of the zinc to the coating layer causes not only the wasteful use of the zinc but also a contamination of the production line due to peeling off of the zinc when the steel sheets move along the path of the production line.

OBJECT OF THE INVENTION

Accordingly, a first object of the invention is to provide an anti-plating agent consisting of an aqueous slurry containing one element selected from the group consisting of the previously proposed five elements of magnesia, boric acid, alkali, alkali salt of silicic acid, titania and titanium hydroxide, with at least one additive selected from a group consisting of alumina, aluminium hydroxide and an alumina zol, thereby to make it possible to produce one-side plated steel sheets while preventing effectively the plating on the side coated by the anti-plating agent, as well as deposition of molten metal onto the surface of the coating layer, and ensuring a good peeling of the film after the baking.

A second object of the invention is to provide an anti-plating agent consisting of an aqueous slurry which is formed by adding alumina or aluminium hydroxide to alkali silicate, boric acid, hydroxide of alkali metal, magnesia and/or magnesium hydroxide and further adding oxide or complex oxide of titanium and/or oxide or complex oxide of zirconium, thereby to make it possible to produce one-side plated steel sheets while preventing effectively the plating on the side of the steel sheet coated by the anti-plating agent, as well as deposition of molten metal onto the surface of the coating film, and ensuring a good peeling of the film after the baking.

SUMMARY OF THE INVENTION

According to one aspect of the invention, there is provided an anti-plating agent consisting of a 6-component aqueous slurry containing at least one of magnesia and magnesium hydroxide, an alkali silicate ($M_2O.nSiO.mH_2O$, m being an alkali metal), boric acid, hydroxide of alkali metal, at least of titania and titanium hydroxide, and at least one of alumina, aluminium hydroxide and alumina zol.

According to another aspect of the invention, there is provided an anti-plating agent consisting of an aqueous slurry which is prepared by adding to water, major constituents including alkali silicate, boric acid, hydroxide of alkali metal, magnesia and/or magnesium hydroxide; alumina and/or aluminium hydroxide and at least one titanium oxide and/or titanium complex oxide and/or at least one zirconium oxide or zirconium complex oxide. In this specification, the terms "titanium oxide" and "complex titanium oxide" are used to mean $TiO_2$, $SrTiO_3$, $BaTiO_3$, $Mg_2TiO_4$ and $CaTiO_3$. Also, the term "zirconium oxide" and "zirconium complex oxide" are used to mean $ZrO_2$, $ZrSiO_3$, $CaZrO_3$ and $BaZrO_3$.

According to the invention, the mean particle size of each constituent of the anti-plating agent is limited as follows, for the reasons which will be described later. Namely, the mean particle size of magnesia or magnesium hydroxide is preferably selected to range between 0.01 and 1 μm, while the mean particle sizes of alumina or aluminium hydroxide, oxide and complex oxide of titanium and oxide and complex oxide of zirconium are preferably selected to fall within the range of between 0.1 and 100 μm.

DESCRIPTION OF THE PREFERRED EMBODIMENTS

A description will be made hereinunder as to how a one-side plated steel sheet is produced by hot dipping using an anti-plating agent in accordance with the invention, before turning to the detailed description of the embodiments.

An aqueous slurry having the above-described composition is applied to one side of a steel sheet after a sufficient degreasing of the steel sheet surface. Then, the steel sheet surface is dried preferably at a temperature not higher than 20° C. The application of the anti-plating agent, i.e. the aqueous slurry, may be made by any known method and tool such as roll type applicator, Spray type applicator, brush or the like. The amount of application of the agent is 5 to 300 g/m$^2$ in the state after the drying. The selection of the amount of application of the agent is important because a too small amount may cause an imperfect coating while a too large amount may cause a cracking in the coating film in the course of the drying, both of which will impede the perfect prevention of plating. As stated before, the drying should be made preferably at a temperature not higher than 200° C. to evaporate the water content of the anti-plating agent, in order to maintain s reducing atmosphere in the subsequent annealing step and in order to avoid cracking and separation of the coating film which may, for otherwise, be caused by an abrupt heating to a high temperature.

After forming a uniform coating film on one side of the steel sheet, the steel sheet is subjected to an annealing conducted at about 700° to 900° C., as in the case of ordinary continous hot dip process and, then cooled down to a temperature approximating the bath temperature which is 460° C. in the case of zinc plating, before the steel is dipped in the plating bath. Meanwhile, the coating film is partly fluidized and becomes glassy by the heat applied during the annealing, and is changed into a solid coat during cooling or dipping, thereby to effectively prevent the molten metal from contacting the coated steel sheet surface in the bath. The steel sheet pulled out from the plating bath has been plated only at one side thereof, while the other side is not plated but is coated by the coating film. This coating film of antiplating agent has an extremely low wettability to the molten metal is observed on the coating film surface after pulling out from the bath. There may be, however, an attaching of dross, although such an attaching takes place only seldom. It is, therefore, advisable to subject the steel sheet to a gas wiping immediately after the plating, preferably with an annealing gas such as butane, propane or the like gas. It proved also that the coating film plays, thanks to its extremely fine and minute structure, the role of an insulator which prevents the ambient air from contacting the steel sheet surface under the cover thereby to perfectly eliminate the undesirable oxidation of that surface by the air.

After the completion of the plating, it is necessary to remove the coating film from the steel sheet. When the anti-plating agent of the invention is used, such a removal can easily be made simply by quenching the steel sheet from a temperature higher than 100° C. in the case of the first-mentioned agent and from a temperature higher than 200° C. in the case of the anti-plating agent mentioned second. The quenching may be made before the solidification of the plating aiming also at an adjustment of the spangle size or may be made after the solidification. It is also possible to effect the quenching after reheating the steel sheet which is once cooled down gradually.

As the way of quenching, immersion in water is easy and effective. An experiment showed that, by effecting the quenching in water, the coating film is completely separated from the steel sheet surface and, in addition, the steel sheet surface revealed after the separation of film is not oxidized at all, so that it is possible to obtain an unplated rolled surface as it is. The separation and removal of the coating film can be made easily by other measure than the described immersion in water, e.g. a repeated slight bending, grinding or polishing. It is possible to obtain a perfect one-side plated steel sheet, by subjecting the steel sheet to a rinsing by water and final finishing washing by a light brushing, after the removal of the coating film.

According to the first form of the invention, it is possible to remarkably eliminate the undesirable deposition of the molten metal to the coating film of the anti-plating agent, which has been experienced in the prior art when the speed of pulling out of the steel sheet is too high or when the annealing is made at a too high temperature, so that a perfect one-side plated steel sheet can easily be obtained.

The above-described advantage is obtained for the first time by the development of the novel anti-plating agent of the invention. The most remarkable effect was obtained when the anti-plating agent is an aqueous slurry prepared by dissolving or dispersing the following matters in the water: 10 g of MgO (a part or whole of MgO may be substituted by $Mg(OH)_2$ of the same molecule number), 1 to 30 g of aqueous solution of alkali silicate as the residual of heat-dehydration ($M_2O.nSiO_2$, n=0.5 to 4), 1 to 30 g of boric acid as $H_3BO_3$, 0.1 to 20 g of alkali as MOH; 1 to 10 g of titania as $TiO_2$ (a part or whole of $TiO_2$ may be substituted by titanium hydroxide of the same molecule number); and 1 to 10 g of alumina as $Al_2O_3$ (a part or whole of $Al_2O_3$ may be substituted by aluminium hydroxide or alumina zol of the same molecule number).

The first embodiment of the invention will be described in detail hereinunder through specific practical examples.

(EXAMPLE 1)

An aqueous slurry was prepared by dispersing the following substances in a suitable amount of water: 10 g of MgO; 10 g of water glass (4.5 g as $Na_2O.2SiO_2$); 4 g of NaOH; 6 g of $H_3BO_3$; 2 g of $TiO_2$; and 3 g of $Al_2O_3$. This aqueous slurry was applied by a roll applicator to one side of a cold-rolled steel which had been cleaned by an ordinary alkali degreasing and rinsing by water. The amount of application was about 50 g/m$^2$ in the state after the drying. After the application, the steel sheet was subjected to a low-temperature drying which was conducted at 150° C. for 1 minute in an oven opened to the atmosphere and then to an annealing which was conducted at 700° for 2 minutes in the atmosphere consisting of 10%$H_2$ and 90%$N_2$ and further to a cooling down to 530° C. in the same atmosphere. The steel sheet was then dipped in a plating bath of molten zinc.

The composition of the plating bath was 0.18% Al-Zn. The temperature of the bath and the dipping time were 465±5° C. and 3 seconds, respectively. After the plating, the steel sheet was pulled out from the plating bath and a gas wiping was conducted with $N_2$ gas to adjust the amount of the plating. Then, when the sheet temperature came down to about 300° C., the steel sheet was quenched by immersion in water of about 20° C. The steel sheet after the plating operation was plated only at its one side while the other side was completely coated by the coating film os the anti-plating agent. The coating film was separated and removed from the steel sheet surface. Subsequently, the steel sheet was rinsed with water and brushing followed by drying by means of a blower. In consequence, a one-side plated steel sheet was obtained to have one side uniformly plated with zinc of about 150 g/m$^2$ and the other side which was the clean cold-rolled surface.

(EXAMPLE 2)

An aqueous slurry was prepared by dissolving or dispersing the following substance in suitable amount of waer: 14.5 g of $Mg(OH)_2$; 10 g of aqueous solution of kalium silicate (6 g as $K_2O.SiO_2$), 6 g of KOH; 5 g of $H_3BO_3$; 3 g of $TiO_2$ and 4 g of $Al(OH)_3$. This slurry was applied in the same manner as Example 1 and the steel sheet applied with this aqueous slurry was treated under the same condition as Example 1. As a result, a perfect one-side plated steel sheet was obtained as in the case of Example 1.

(EXAMPLE 3)

A plurality of one-side plated steel sheets were produced using anti-plating agent of compositions shown in Table 1. Three different annealing temperatures of 700° C., 750° C. and 850° C. were employed. Also, two different pulling out speeds of 40 mpm and 60 mpm were used. Then, a test was conducted to investigate how the deposition of molten zinc and the easiness of removal of the coating film of the anti-plating agent are affected by the change of annealing temperature and the change of the pull out speed, the result of which is shown in Table 1. In Table 1, the deposition of zinc and easiness of removal of the coating layer are evaluated as follows.

(1) deposition of zinc
- O: almost no deposition of molten zinc to the surface of coating film of anti-plating agent
- Δ: molten zinc deposited to a part of coating film
- X: molten zinc deposited to whole surface of coating film (2) easiness of separation and removal of anti-plating agent
- O: complete separation
- Δ: partly separated
- X: no separation at all As will be clearly seen from Table 1, the use of the anti-plating agent of the invention ensures almost no deposition of molten zinc to the surface of the antiplating coating film and an easy separation of the coating film by water-cooling or repeated slight bending, even when the annealing temperature is elevated and even when the speed of pulling out from the molten zinc bath is increased to 60 mpm.

TABLE 1

| No. | composition of anti-plating agent (g) | | | | | | annealing temp. (°C.) | deposition molten zinc pull-out speed 40 mpm | deposition molten zinc pullout speed 60 mpm | peel of anti-plating agent film by water cooling | peel of anti-plating agent film by bending |
|---|---|---|---|---|---|---|---|---|---|---|---|
| prior art | MgO | water glass | NaOH | $H_3BO_3$ | | | 700 | X | X | O | O |
| | | | | | | | 750 | X | X | O | O |
| (1) | 10g | 10g | 4g | 6g | | | 850 | X | X | O | O |
| prior art | MgO | water glass | NaOH | $H_3BO_3$ | $TiO_2$ | | 700 | O | Δ | O | O |
| | | | | | | | 750 | Δ | X | O | O |
| (2) | 10g | 10g | 4g | 6g | 3g | | 850 | X | X | O | O |
| present invention | MgO | water glass | NaOH | $H_3BO_3$ | $TiO_2$ | $Al_2O_3$ | 700 | O | O | O | O |
| | | | | | | | 750 | O | O | O | O |
| (1) | 10g | 10g | 4g | 6g | 3g | 3g | 850 | O | O | O | O |
| | MgO | water glass | KOH | $H_3BO_3$ | $TiO_2$ | $Al_2O_3$ | 700 | O | O | Δ | O |
| | | | | | | | 750 | O | O | O | O |
| (2) | 10g | 10g | 6g | 5g | 5g | 6g | 850 | O | O | O | O |
| | $Mg(OH)_2K_2O.SiO_2$ | | NaOH | $H_3BO_3$ | $Ti(OH)_4$ | $Al(OH)_3$ | 700 | O | O | Δ | O |
| | | | | | | | 750 | O | O | Δ | O |
| (3) | 14g | 6g | 5g | 7g | 4g | 8g | 850 | O | O | O | O |
| | $Mg(OH)_2K_2O.SiO$ | | NaOH | $H_3BO_3$ | $Ti(OH)_4$ | $Al(OH)_3$ | 700 | O | O | O | O |
| | | | | | | | 750 | O | O | O | O |
| (4) | 14g | 6g | 4g | 6g | 2g | 4g | 850 | O | O | O | O |

In the anti-plating agent in accordance with the second form of the invention, the alkali silicate, boric acid and the alkali metal hydroxide mainly serve to prevent the plating and also to prevent oxidation of the steel sheet after the plating. On the other hand, the prevention of deposition of the molten metal onto the coating film surface is achieved mainly by magnesia or magnesium hydroxide, alumina or aluminium hydroxide, and oxide and/or complex hydroxide of titanium and/or zirconium. Particularly, the addition of alumina or aluminium hydroxide, and oxide and/or complexed oxide of titanium and zirconium completely eliminates the undesirable deposition of molten metal onto the coating film surface and facilitates the separation of the coating film, which have been experienced in the known anti-plating agents proposed by the present applicant when the speed of pulling out from the molten metal bath is too high or when the annealing temperature is too high, thereby to ensure a superior quality of the one-side plated steel sheet.

The highest effects or prevention of plating, prevention of deposition of molten metal to the coating film surface and facilitation of separation of the baked film were obtained when the anti-plating agent was prepared by adding selective components B to common components A in accordance with the following examples B-1 to B-3.

| | | |
|---|---|---|
| (A) common components (weight part) | | |
| | alkali silicate | 0.5 to 30 |
| | boric acid | 0.5 to 30 |
| | alkali metal hydroxide | 0.5 to 20 |
| | one or both of magnesia and magnesium hydroxide | 1 to 30 |
| | one or both of alumina and aluminium hydroxide | 1 to 20 |
| (B) selective component (weight part) | | |
| (B-1) | at least one kind of titanium oxide and/or titanium complex oxide | 1 to 20 |
| (B-2) | at least one kind of zirconium oxide and/or zirconium complex oxide | 1 to 20 |
| (B-3) | at least one kind of titanium oxide and/or titanium complex oxide at least one kind of zirconium oxide and/or zirconium complex oxide | 1 to 20 |

Preferably, the mean particle size of the magnesia and magnesium hydroxide is selected to range between 0.01 and 1 μm. It is also preferred that alumina and aluminium hydroxide, and oxides and complex oxides of titanium and zirconium have mean particle sizes which fall within the range of between 0.1 and 100 μm. Mean particle size of magnesia and magnesium hydroxide less than 0.01 μm is impractical because such a small particle size permits a secular change of the aqueous slurry and solidification of the same, although superior effects of prevention of plating, prevention of deposition of molten metal and easiness of separation of coating film are obtainable even with such small particle size. On the other hand, the effect of prevention of plating is decreased and the separation of the coating film is made difficult when the mean particle size is increased beyond 1 μm.

Mean particle sizes of alumina and aluminium hydroxide, and oxides and complex oxides of titanium and zirconium less than 0.1 m permits the formation of numerous pin holes in the surface of the baked surface to deteriorate the anti-plating effect and to cause an oxidation of the steel sheet surface. Also, the tendency of secular change of the aqueous slurry as the anti-plating agent is promoted by such small particle size. To the contrary, when the mean particle size exceeds 100 μm, the peeling of the baked film is deteriorated and the application of the aqueous slurry by the roll applicator, spray and so forth is made difficult.

By selecting the composition ratio of the antiplating agent as stated above while determining the mean particle sizes of the magnesia, magnesium hydroxide, alumina, aluminium hydroxide and oxides and complexed oxides of titanium and zirconium as stated above, it is possible to obtain a one-side plated steel sheet with superior effecs of prevention of plating, prevention of deposition of molten metal on the coating film and easiness of separation of the baked film.

Practical examples of the anti-plating agent in accordance with the second form of the invention will be explained hereinunder.

(EXAMPLE 1)

An aqueous solution was prepared by dissolving or dispersing the following substances on suitable amount of water: 10 g of MgO; 10 g of water glass (4.5 g as $Na_2O.2SiO_2$); 4 g of NaOH; 6 g of $H_3BO_3$; 2 g of $BaTiO_3$ and 3 g of $Al_2O_3$. The slurry was applied onto one side of a steel sheet which had been cleaned by ordinary alkali degreasing and rinsing by water, using a roll applicator by an amount of about 50 g/m$^2$ in the state after drying. The steel sheet was then dried for 1 minute at a low temperature of 150° C. in an oven opened to the atmosphere, and was subjected to an annealing conducted for 2 minutes in an atmosphere consisting of $10\%H_2+90\%N_2$, followed by a cooling down to 530° C. in the same atmosphere. The steel sheet was then dipped in a molten zinc plating bath of 0.18%Al-Zn for plating with zinc. The bath temperature and the dipping time were 465±5° C. and 3 seconds, respectively. The steel was pulled out from the bath and was wiped by a gas wiper while it is still held just above the bath, for adjusting the amount of zinc attaching thereto. Then, when the steel sheet temperature was lowered to about 300° C., the steel sheet was immersed in water of about 20° C. for quenching.

The steel sheet after the plating was plated at its one side while the other side was completely coated by the anti-plating coating film. The coating film, however, could easily be separated by the quenching in the water. The steel sheet was then rinsed by water and was subjected to a brushing following by drying by means of a blower. In consequence, a one-side plated steel sheet was obtained to have one side uniformly plated with zinc at a rate of about 150 g/m$^2$ while the other side presented clean cold-rolled surface.

(EXAMPLE 2)

An aqueous slurry was prepared by dissolving or dispersing the following substances in suitable amount of water: 14.5 g of $Mg(OH)_2$; 10 g of aqueous solution of kalium silicate (6 g as $K_2O.SiO_2$); 6 g of KOH; 5 g of $H_3BO_3$; 3 g of $ZrSiO_3$ and 4 g of $Al(OH)_3$. A zinc plating was conducted in the same manner as Example 1 using the above-mentioned aqueous slurry as the anti-plating agent. The plated steel sheet was slightly bent in water (one-time bending at 30°) to separate the coating film. The steel sheet was then subjected to rinsing by water, brushing and drying by a blower. In consequence, a perfect one-side plated steel sheet plated only at one side with zinc was obtained as in the case of Example 1.

(EXAMPLE 3)

An aqueous slurry was prepared by dissolving or dispersing the following matters in suitable amount of water: 20 g of MgO; 15 g of water glass; 10 g of $H_3BO_3$; 8 g of NaOH; 3.5 g of $TiO_2$; 5 g of $Al(OH)_3$ and 5 g of $ZrO_2$. A plating was conducted under the same condition as Example 1 using the above-mentioned aqueous slurry as the anti-plating agent. In consequence, a perfect one-side zinc plated steel sheet was obtained equally to the case of Example 1.

(EXAMPLE 4)

The stability or resistance to secular change of the aqueous slurries was examined with various conventional compositions and compositions in accordance with the invention of the anti-plating agent, while varying the particle sizes of the constituents. The test was conducted using these anti-plating agents while employing two different annealing temperatures of 750° C. and 850° C. and two different pull-out speeds of 40 mpm and 60 mpm, to check for the anti-plating effect, deposition of molten zinc to the coating film layer and the easiness of separation of the baked film, the result of which is shown in Table 2. The method of evaluation of the property is shown in Table 3.

As will be clearly seen from Table 2, the use of the anti-plating agents of the invention ensures almost no deposition of the molten zinc onto the surface of the coating film of the anti-plating agent and an easy separation of the coating film by bending, even when the annealing temperature is increased and the speed of pulling out is increased to 60 mpm.

Although the preferred embodiments have been described with specific reference to the case of hot dip zinc plating on one side of a steel sheet, it will be clear to those skilled in the art that the anti-plating agent of the invention can equally be applied to the hot dip plating process with Al, Zn-Al, Sn, Pb, Pb-Sn and the like material.

TABLE 2

| No. | composition of anti-plating agent (g) | | | | | | | mean particle size of MgO or Mg(OH) | mean particle size of MgO or Mg(OH) | secular stability of agent in aqueous slurry state | annealing temp. °C. | deposition of molten zinc pull-out speed 40 | deposition of molten zinc 60 mpm | anti-plating power | peeling* of coating film |
|---|---|---|---|---|---|---|---|---|---|---|---|---|---|---|---|
| prior art | water glass | MgO | NaOH | $H_3BO_3$ | | | | 0.05 | | O | 750 | X | X | O | O |
| (1) | 10 | 10 | 4 | 6 | | | | | | | 850 | X | X | O | O |
| prior art | water glass | MgO | NaOH | $H_3BO_3$ | $TiO_2$ | | | 0.5 | 0.5 | O | 750 | | X | O | O |
| (2) | 10 | 10 | 4 | 6 | 3 | | | | | | 850 | X | X | O | O |
| prior art | $K_2O.SiO_2$ | MgO | NaOH | $H_3BO_3$ | $TiO_2$ | | | 5 | 1.0 | O | 750 | | X | | X |
| (3) | 8 | 10 | 4 | 8 | 5 | | | | | | 850 | X | X | | X |
| prior art | meta bolic sodium silicate | MgO | | | | | | | | | 750 | X | X | X | X |
| (4) | 6 | 21 | | | | | | | | | 850 | X | X | X | X |
| prior art | amino sodium silicate | | | | | | | | | | 750 | X | X | O | |
| (5) | 10 | | | | | | | | | | 850 | X | X | O | |
| prior art | water glass | | | | | | | | | | 750 | X | X | X | X |
| (6) | 10 | | | | | | | | | | 850 | X | X | X | X |

| No. | composition of anti-plating agent (g) | | | | | | | mean particle size of MgO or $Mg(OH)_2$ | mean particle size of MgO or $Mg(OH)_2$ | secular stability of agent in aqueous slurry state | annealing temp. °C. | deposition of molten zinc pull-out speed 40 mpm | deposition of molten zinc 60 mpm | anti-plating power | peeling* of coating film |
|---|---|---|---|---|---|---|---|---|---|---|---|---|---|---|---|
| present invention | water glass | MgO | NaOH | $H_3BO_3$ | $Al_2O_3$ | $TiO_2$ | | 10 | 0.05–30 | O | 750 | O | O | Δ | Δ |
| (1) | 10 | 10 | 4 | 6 | 3 | 3 | | | | | 850 | O | O | Δ | X |
| present invention | water glass | MgO | NaOH | $H_3BO_3$ | $Al_2O_3$ | $TiO_2$ | | 0.005 | 0.5–70 | X | 750 | O | O | O | O |
| (2) | 10 | 10 | 4 | 6 | 3 | 3 | | | | | 850 | O | O | O | O |
| present invention | $K_2O.SiO_2$ | MgO | NaOH | $H_3BO_3$ | $Al_2O_3$ | $TiO_2$ | | 0.8 | 1–70 | O | 750 | O | O | O | O |
| (3) | 8 | 12 | 6 | 8 | 3 | 3 | | | | | 850 | O | O | O | O |
| present invention | $K_2O.SiO_2$ | MgO | NaOH | $H_3BO_3$ | $Al_2O_3$ | $BaTiO_3$ | | 0.1 | 1–30 | O | 750 | O | O | O | O |
| (4) | 12 | 14 | 9 | 10 | 2 | 6 | | | | | 850 | O | O | O | O |
| present invention | water glass | MgO | KOH | $H_3BO_3$ | $Al(OH)_3$ | $ZrO_2$ | | 0.9 | 0.1–1 | O | 750 | O | O | O | O |
| (5) | 20 | 22 | 10 | 14 | 5 | 3 | | | | | 850 | O | O | O | O |
| present invention | water glass | MgO | KOH | $H_3BO_3$ | $Al_2O_3$ | $ZrSiO_3$ | $TiO_2$ | 0.05 | 0.8–50 | O | 750 | O | O | O | O |
| (6) | 8 | 11 | 5 | 3 | 1 | 2 | 3 | | | | 850 | O | O | O | O |
| present invention | $K_2O.SiO_2$ | $Mg(OH)_2$ | NaOH | $H_3BO_3$ | $Al(OH)_3$ | $CaZrO_3$ | $Mg_2TiO_4$ | 0.02 | 0.2–80 | O | 750 | O | O | O | O |
| (7) | 15 | 16 | 3 | 6 | 8 | 3 | 4 | | | | 850 | O | O | O | O |

TABLE 2-continued

| | | | | | | | | | | | | | | | |
|---|---|---|---|---|---|---|---|---|---|---|---|---|---|---|---|
| present invention | water glass | $Mg(OH)_2$ | NaOH | $H_3BO_3$ | $Al(OH)_3$ | $TiO_2$ | $CaTiO_3$ | | 0.5 | 0.5–20 | O | 750 | O | O | O | O |
| (8) | 16 | 13 | 6 | 9 | 1 | 3.5 | 2 | | | | | 850 | O | O | O | O |
| present invention | water glass | MgO | KOH | $H_3BO_3$ | $Al_2O_3$ | $TiO_2$ | $Mg_2TiO_4$ | $BaZrO_3$ | 0.05 | 0.2–30 | O | 750 | O | O | O | O |
| (9) | 11 | 12 | 5 | 7 | 2 | 3 | 1 | 1 | | | | 850 | O | O | O | O |
| present invention | water glass | MgO | $Mg(OH)_2$ | NaOH | $H_3BO_3$ | $Al_2O_3$ | $TiO_2$ | | 0.01 | 10–50 | O | 750 | O | O | O | O |
| (10) | 25 | 10 | 5 | 10 | 16 | 2 | 3 | | | | | 850 | O | O | O | O |
| present invention | $K_2O.SiO_2$ | MgO | NaOH | $H_3BO_3$ | $Al(OH)_3$ | $Mg_2TiO_4$ | | | 5 | 10–30 | O | 750 | O | O | Δ | X |
| (11) | 5 | 20 | 15 | 23 | 3 | 3 | | | | | | 850 | O | O | Δ | X |
| present invention | water glass | MgO | NaOH | $H_3BO_3$ | $Al(OH)_3$ | $Al_2O_3$ | $SrTiO_3$ | $ZrO_2$ | 0.08 | 1–60 | O | 750 | O | O | O | O |
| (12) | 18 | 18 | 3 | 9 | 0.5 | 4 | 3 | 1 | | | | 850 | O | O | O | O |
| present invention | water glass | MgO | KOH | $H_3BO_3$ | $Al(OH)_3$ | $CaTiO_3$ | $TiO_2$ | $ZrSiO_3$ | 0.5 | 0.1–1 | O | 750 | O | O | O | O |
| (13) | 15 | 10 | 7 | 13 | 10 | 10 | 4 | 5 | | | | 850 | O | O | O | O |

*one time bend in water (bending angle 30°)

TABLE 3

| Evaluation Method | | | |
|---|---|---|---|
| Evaluation | | | |
| stability of anti-plating aqueous slurry | deposition of molten zinc | anti-plating effect | peeling of baked film |
| no change over 10 days | almost no deposition of zinc on baked film surface | no temper color and no deposition of Zn on steel surface | perfect peeling |
| changed in 5 to 6 days | attaching of zinc to a part of baked film surface | temper color on a part of steel surface | partly peeled |
| changed in several hours | zinc attached to whole surface of baked film | temper color and Zn deposition on steel surface | no peeling |

As will be seen from the foregoing description, by using the anti-plating agent in accordance with the invention, it is possible to eliminate the undesirable decomposition and peeling off of the anti-plating coating film which were often experienced in the prior art during annealing, so that the plating on the other side of the steel sheet is perfectly prevented. In addition, the steel sheet surface revealed after the removal of the coating film is never oxidized nor changed in state and held in the name state as that presented before the plating, in contrast to the prior art in which the steel sheet surface is oxidized or changed in the state after the removal of the coating film.

What is claimed is:

1. An anti-plating agent for use in one-side hot-dip plating process consisting of an aqueous slurry which is prepared by dissolving or dispersing the following substances in water: an alkali metal silicate; boric acid; a hydroxide of an alkali metal; at least one of magnesia and magnesium hydroxide; at least one of titania and titanium hydroxide; and at least one aluminium compound selected from a group consisting of alumina, aluminium hydroxide and alumina sol.

2. An anti-plating agent as claimed in claim 1, characterized by containing 0.5 to 30 wt parts of an alkali metal silicate; 0.5 to 30 wt parts of boric acid; 0.5 to 20 wt parts of a hydroxide of an alkali metal; 1 to 30 wt parts of at least one of magnesia and magnesium hydroxide; 1 to 20 wt parts of at least one of titania and titanium hydroxide; and 1 to 20 wt parts of said aluminium compound.

3. An anti-plating agent for use in one-side hot-dip plating process consisting of an aqueous slurry which is prepared by dissolving or dispersing the following substances in water: an alkali metal silicate; boric acid; a hydroxide of an alkali metal; at least one of magnesia and magnesium hydroxide; at least one of alumina or aluminium hydroxide; at least one of titanium oxide, titanium complex oxide zirconium oxide and zirconium complex oxide.

4. An anti-plating agent as claimed in claim 3, characterized by containing 0.5 to 30 wt parts of an alkali silicate; 0.5 to 30 wt parts of boric acid; 0.5 to 20 wt parts of a hydroxide of an alkali metal; 1 to 30 wt parts of at least one of magnesia and magnesium hydroxide; 1 to 20 parts of at least one of alumina or aluminium hydroxide; 1 to 20 wt parts of at least one of titanium oxide, titanium complex oxide, zirconium oxide and zirconium complex oxide.

5. An anti-plating agent as claimed in either one of claims 3 and 4, wherein said titanium oxide and said titanium complex oxide are selected from a group consisting of $TiO_2$, $SrTiO_3$, $BaTiO_3$, $Mg_2TiO_4$ and $CaTiO_3$.

6. An anti-plating agent as claimed in either one of claims 3 and 4, wherein said zirconium oxide and said zirconium complex oxide are selected from a group consisting of $ZrO_2$, $ZrSiO_3$, $CaZr_3$ and $BaZrO_3$.

7. An anti-plating agent as claimed in either one of claims 3 and 4, characterized in that the mean particle size of said magnesia and magnesium hydroxide ranges between 0.01 and 1 μm, and that the mean particle size of said alumina, aluminium hydroxide, titanium oxide, titanium complex oxide, zirconium oxide and zirconium complex oxide ranges between 0.1 and 100 μm.

* * * * *